US007556173B2

(12) United States Patent
Solowiejko

(10) Patent No.: US 7,556,173 B2
(45) Date of Patent: Jul. 7, 2009

(54) CONTAINER HAVING PIVOTING LID

(75) Inventor: George Solowiejko, Rockford, IL (US)

(73) Assignee: J.L. Clark, Inc., Rockford, IL (US)

( * ) Notice: Subject to any disclaimer, the term of this patent is extended or adjusted under 35 U.S.C. 154(b) by 490 days.

(21) Appl. No.: 11/343,092

(22) Filed: Jan. 30, 2006

(65) Prior Publication Data

US 2007/0175909 A1 Aug. 2, 2007

(51) Int. Cl.

| | |
|---|---|
| ***B65D 43/04*** | (2006.01) |
| ***B65D 43/14*** | (2006.01) |
| ***B65D 47/00*** | (2006.01) |
| *B67D 3/00* | (2006.01) |

(52) U.S. Cl. ..... 220/825; 220/281

(58) Field of Classification Search ..... 220/825–827, 220/281–283, 837, 831, 254.3, 833; 222/480, 222/482, 517, 472, 556, 557

See application file for complete search history.

(56) References Cited

U.S. PATENT DOCUMENTS

| | | | | |
|---|---|---|---|---|
| D278,207 | S | 4/1985 | McLaughlin | |
| D314,708 | S | 2/1991 | DeCoster | |
| 5,029,723 | A * | 7/1991 | Lo | 220/282 |
| D349,644 | S | 8/1994 | Miyairi et al. | |
| D382,769 | S | 8/1997 | Jeppesen et al. | |
| D448,668 | S | 10/2001 | Baerenwald et al. | |
| D456,713 | S | 5/2002 | Bried et al. | |
| D464,567 | S | 10/2002 | Baerenwald et al. | |
| 6,471,083 | B1 * | 10/2002 | Helms | 220/259.1 |
| D475,282 | S | 6/2003 | Snaith et al. | |
| D480,635 | S | 10/2003 | Caroen | |
| D480,636 | S | 10/2003 | Caroen | |
| 6,691,394 | B1 * | 2/2004 | McClean | 29/434 |
| 7,051,894 | B2 * | 5/2006 | Barnes et al. | 220/254.5 |
| 2007/0170185 | A1 * | 7/2007 | Hanssen et al. | 220/259.2 |

* cited by examiner

*Primary Examiner*—Robin Hylton
(74) *Attorney, Agent, or Firm*—Leydig, Voit & Mayer, Ltd.

(57) ABSTRACT

The container assembly includes a container and a deformable lid. The container has a wall that extends between a base and an open end and includes a fulcrum. The deformable lid includes a mounting portion, a depressible portion, and a dispensing portion. The deformable lid is mounted on the container to enclose the open end. The mounting portion is joined to the depressible portion at a first hinge and the dispensing portion is joined to the depressible portion at a second hinge. When the depressible portion is depressed toward the base, the first hinge permits the depressible portion to collapse into the container, the second hinge permits the dispensing portion to slide upon the fulcrum, and the fulcrum biases a forward portion of the dispensing portion away from the base such that the forward portion protrudes from the container.

20 Claims, 6 Drawing Sheets

CONTAINER HAVING PIVOTING LID

FIELD OF THE INVENTION

The present invention relates generally to containers, and more particularly relates to containers having deformable lids.

BACKGROUND OF THE INVENTION

Container assemblies are used to store a plethora of goods (e.g., candies) and come in all different shapes, sizes, and colors. A typical container assembly generally includes a container having an open end and a lid to cover that open end. To ensure that the lid is appropriately secured to the container and closes the open end, the container and the lid are often outfitted with one of a variety of different securing features. For example, the container and the lid can be fashioned with threads, a hinge assembly, or a living hinge. Likewise, the container and the lid can have closely matched outer peripheries such that the lid will friction fit over the container. No matter what method and/or apparatus is employed, the lid has to be securable to the container proximate the open end to ensure that the contents of the container assembly remain housed therein until a user of the container assembly desires to dispense those contents.

Just as the size, shape, and color of the container assembly can vary, so too can the different types of openings and structures used to dispense the goods from the container assembly vary. Unfortunately, many of these different openings and/or structures are inefficient and burdensome for the user of the container assembly. For example, in a container assembly employing mated threads on the container and the lid, the user of the container assembly must unscrew and completely remove the lid from the container to retrieve the goods stored in the container. In another example, where a lid is secured to a container using a hinge assembly, the lid often requires a clasp or other securing feature at an opposing end of the lid. Without such a clasp, the lid would be free to pivot about the hinge assembly. As a result, opening the container assembly with a hinge assembly requires that two hands be used to dispense the goods. One hand to steady the container, the other hand to operate the clasp.

Unfortunately, too many of the containers assemblies are difficult to move from an "open position", where the container assembly contents can be dispensed, to a "closed position", where the container assembly contents cannot be dispensed. Also, for one reason or another, container assemblies often require two hands to manipulate the container assembly between the open position and the closed position. The prior art has failed to adequately remedy these problems.

BRIEF SUMMARY OF THE INVENTION

In one aspect, the invention provides a container assembly. The container assembly comprises a container and a deformable lid. The container has a wall extending between a base and an open end and a fulcrum. The deformable lid includes a mounting portion, a depressible portion, and a dispensing portion. The deformable lid is mounted on the container to enclose the open end. The mounting portion is joined to the depressible portion at a first hinge. The dispensing portion is joined to the depressible portion at a second hinge. When the depressible portion is depressed toward the base, the first hinge permits the depressible portion to collapse into the container, the second hinge permits the dispensing portion to slide upon the fulcrum, and the fulcrum biases a forward portion of the dispensing portion away from the base. As such, the forward portion protrudes from the container.

In another aspect, the invention provides a container assembly. The container assembly comprises a container and a deformable lid. The container includes a pivot pin, a first stop, and a second stop. The deformable lid is securable to the container. The deformable lid has a depressible portion and a dispensing portion. When the depressible portion is depressed, the depressible portion collapses into the container until the first stop is engaged, the dispensing portion slides upon the pivot pin and disengages from the second stop, and a forward portion of the dispensing portion protrudes from the container.

In yet another aspect, the invention provides a container assembly. The container assembly comprises a container and a deformable lid. The container includes a base and a wall having a shaft, a pivot pin, and first and second stops. The deformable lid includes a mounting portion, a depressible portion, and a dispensing portion. The mounting portion has a hollow shaft that is engageable with the shaft. As such, the deformable lid is securable to the container. The depressible portion is adjacent to the mounting portion. The depressible portion has a tapered distal edge. The tapered distal edge tapers upwardly away from the base beginning proximate the mounting portion. The tapered distal edge is engageable with the first stop. The dispensing portion is adjacent to the depressible portion. The dispensing portion has a cam surface, an edge, and a dispensing opening. The cam surface is slidable upon the pivot pin. The edge is disengagable from the second stop. The dispensing opening is temporarily blocked by the wall portion of the container. When the depressible portion is depressed, the cam surface slides upon the pivot pin and the dispensing opening moves away from the base portion. As such, the dispensing portion is no longer blocked by the wall portion of the container.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
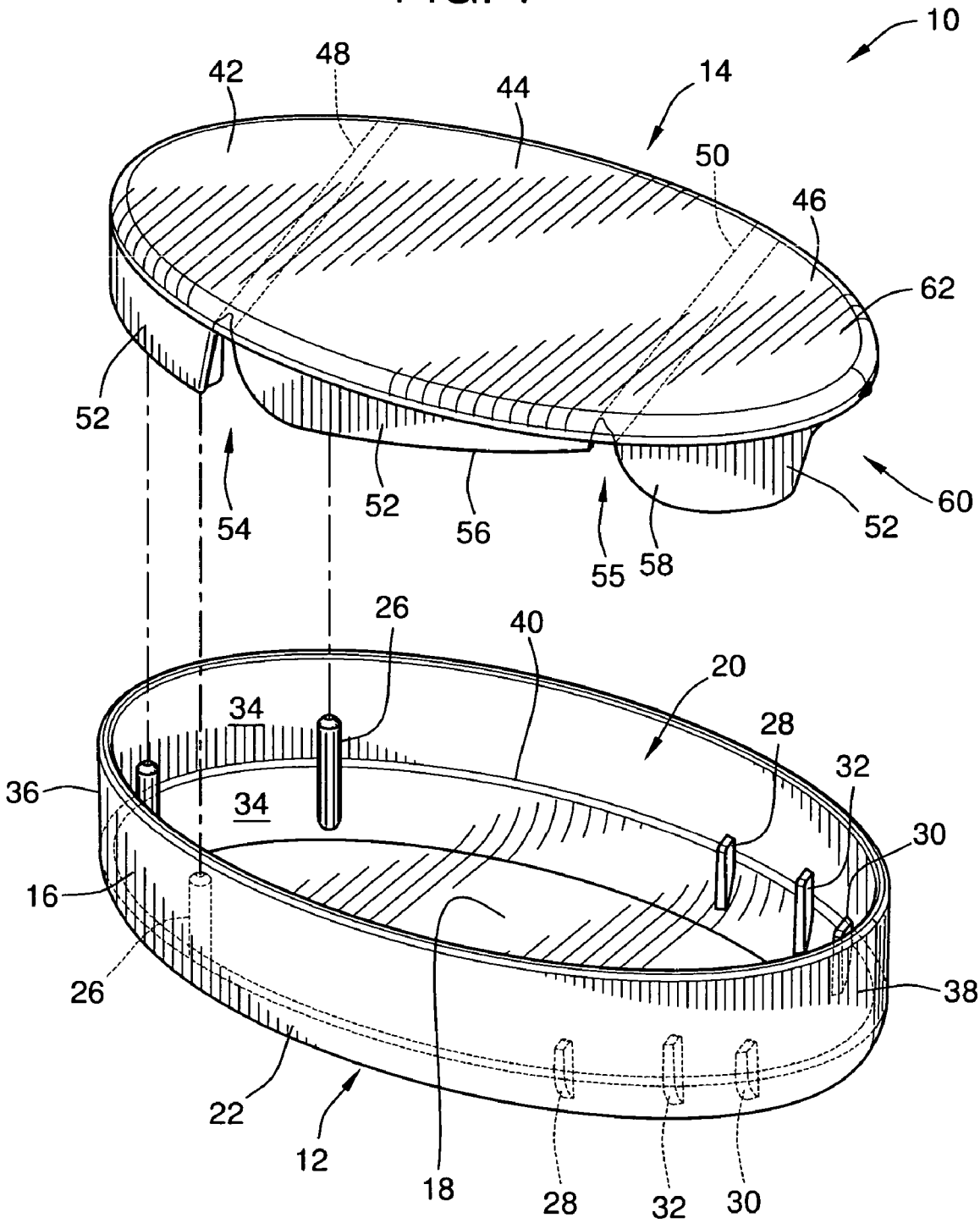
FIG. 1 is an exploded perspective view of an exemplary embodiment of a container assembly constructed in accordance with the teachings of the present invention.
Figure 2:
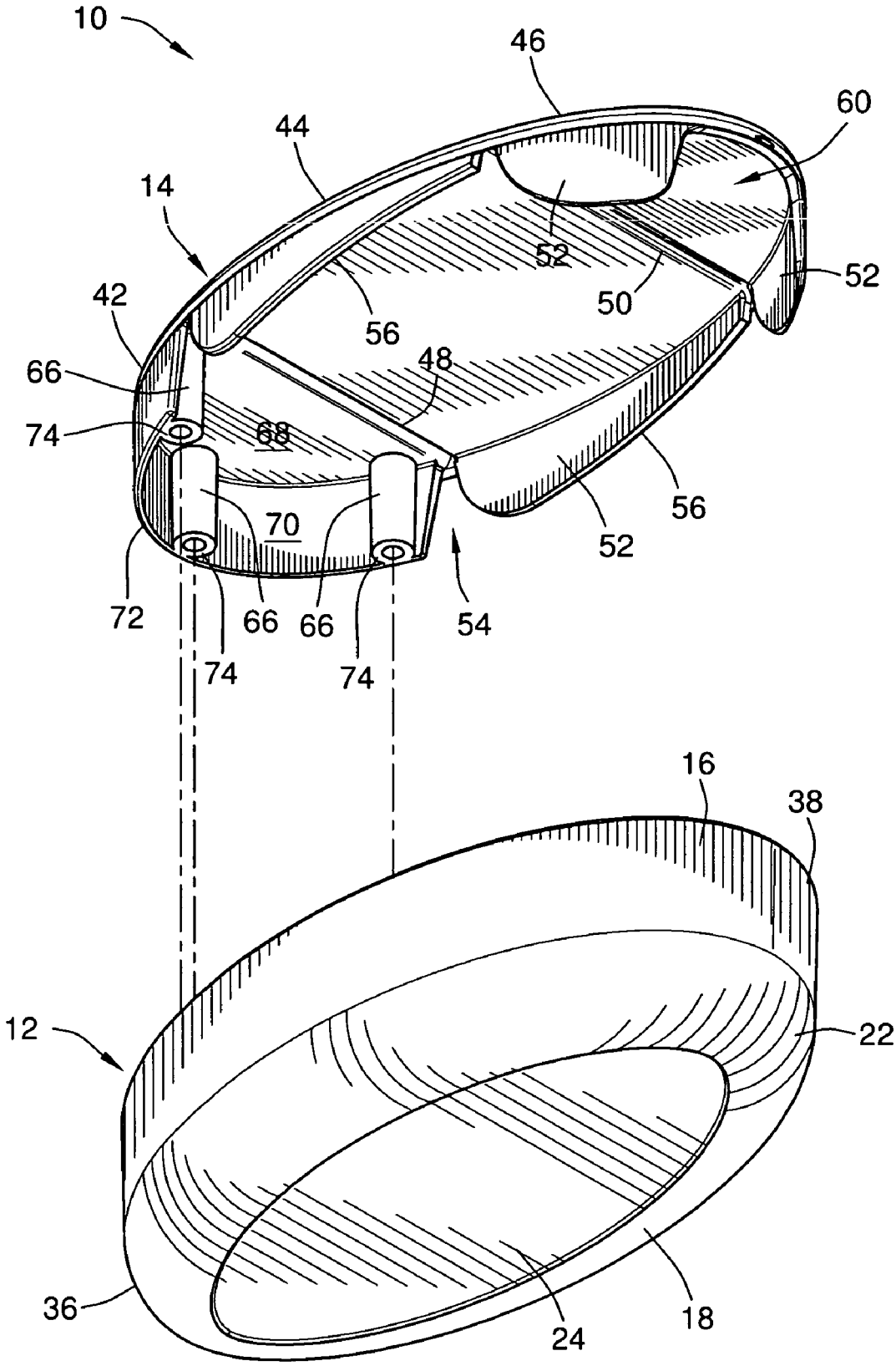
FIG. 2 is an exploded perspective view of the container assembly of FIG. 1 taken from an alternate vantage point.
Figure 3:
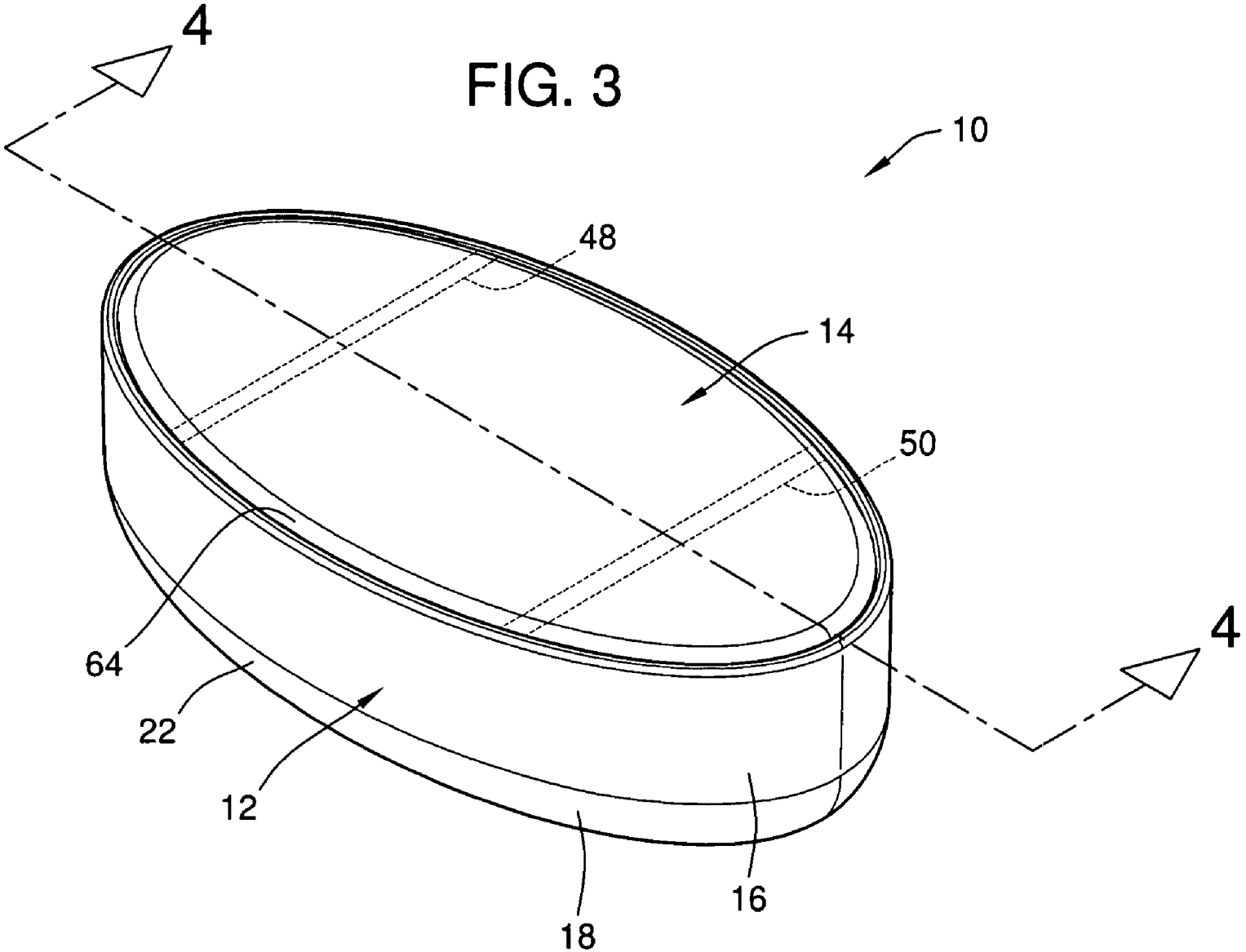
FIG. 3 is a perspective view of the container assembly of FIGS. 1-2 when assembled and in a closed position.

Referring collectively to FIGS. 1-3, one embodiment of a container assembly 10 is shown. The container assembly 10 is shown in an exploded view in FIGS. 1-2 and is shown in an assembled condition in FIG. 3. The container assembly 10 is particularly suited to temporarily store and selectively dispense a product such as, for example, candies. The container assembly 10 can be easily manipulated, using a single finger or just one hand, between an open and a closed position as will be discussed more fully below.

As illustrated in FIGS. 1 and 2, the container assembly 10 comprises a container 12 and a deformable lid 14. The container assembly 10 is sized, dimensioned and/or configured to hold a variety of different products therein. These products can be candies, as earlier noted, as well as other edible and non-edible items. Although the container assembly can assume a variety of shapes, in one embodiment, the container assembly is generally oval. Additionally, even though the container assembly can be constructed from a variety of materials, in one embodiment, the container is manufactured from a plastic such as, for example, polypropylene and polyethylene. The plastic material can be entirely transparent, completely colored, or some combination thereof. As such, contents of the container can be easily viewable from outside the container assembly 10 or partially or completely hidden from view.

Referring to FIGS. 1-2, the container 12 generally comprises a wall 16 extending between a base 18 and an open end 20. In one embodiment, the container 12 can also include a beveled portion 22 generally disposed between the wall 16 and the base 18 and extending circumferentially around the container. The base 18 may also include an indent portion 24.

As illustrated in FIG. 1, the container 12 includes a shaft 26, a first stop 28, a second stop 30, and a fulcrum 32. In one embodiment, opposing pairs and/or a plurality of the shafts 26, the first stops 28, the second stops 30, and the fulcrums 32 are disposed within the container 12. The shafts 26 generally extend upwardly from the base 18 toward the open end 20 of the container 12 as oriented in FIG. 1. The shafts 26 are secured to or integrally formed with the base 18, an inner wall surface 34, and/or both the base and the inner wall surface. The shafts 26 are generally disposed proximate a first end 36 of the container 12 while the first stop 28, the second stop 30, and the fulcrum 32 are disposed proximate an opposing second end 38 of the container 12.

As illustrated in FIG. 1, in one embodiment, an opposing pair of first stops 28, an opposing pair of second stops 30, and an opposing pair of fulcrums 32 are found within the container 12. In this embodiment, the opposing pair of fulcrums 32 is interposed between the opposing pair of first stops 28 and the opposing pair of second stops 30. In one embodiment, the fulcrum 32 extends upwardly (i.e., towards the open end 20 and away from base 18) to a greater extent than either of the pair of first stops 28 and the pair of second stops 30.

Figure 4:
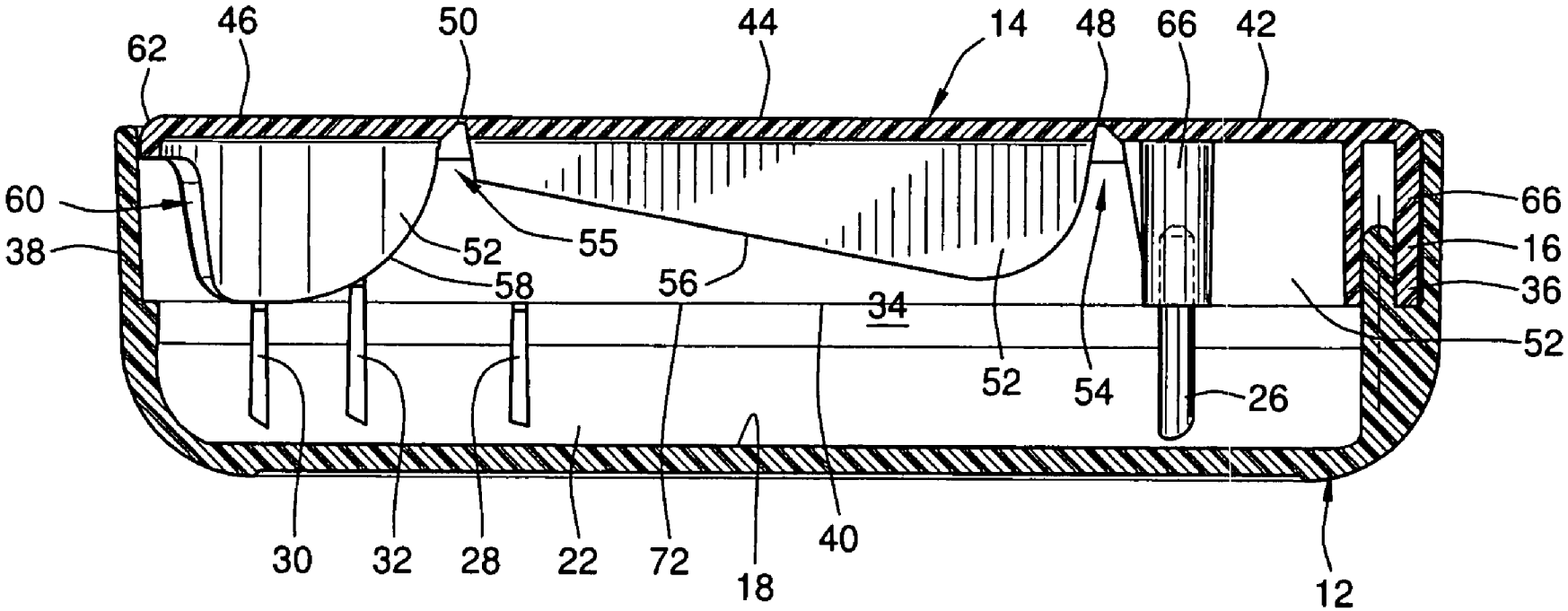
FIG. 4 is a cross-sectional view of the container assembly of FIG. 3, taken generally along line 4-4, in the closed position.

In one embodiment, the container 12 includes a ledge 40 that circumferentially progresses around an inner wall 34 of the container 12. In such an embodiment, as illustrated in FIGS. 1 and 4, each of the shafts 26 and the fulcrum 32 extend above the ledge 40. In contrast, each of the first stops 28 and the second stops 30 are upwardly bounded by the ledge. In other words, the fulcrums 32 and the shafts 26 are generally longer and/or taller than the first and second stops 28, 30.

Referring to FIG. 1, the deformable lid 14 comprises a mounting portion 42, a depressible portion 44, a dispensable portion 46, a first hinge 48, and a second hinge 50. The mounting portion 42 and the depressible portion 44 are generally adjacent to each other and are joined and/or coupled together by the first hinge 48. Therefore, the depressible portion 44 can move and/or rotate relative to the mounting portion 42 courtesy of the first hinge 48. Likewise, the depressible portion 44 and the dispensable portion 46 are generally adjacent to each other and joined and/or coupled together by the second hinge 50. As such, the depressible portion 44 and the dispensable portion 46 can move relative to each other courtesy of the second hinge.

In one embodiment, the deformable lid 14 comprises a segmented skirt 52 depending from the deformable lid. The segmented skirt 52 is generally transverse to the mounting portion 42, the depressible portion 44, and the dispensable portion 46. The segmented skirt 52 is "segmented" by gaps 54, 55 that are formed in the segmented skirt. The gaps 54, 55 are found adjacent to and aligned with ends of the first and second hinges 48, 50. The gaps 54, 55 are compressible and/or expandable as the mounting portion 42, the depressible portion 44, and/or the dispensable portion 46 move and/or rotate relative to one another.

In one embodiment, the segmented skirt 52 includes, below and proximate the depressible portion 44, a tapered distal edge 56. The tapered distal edge 56 is generally tapered upwardly (away from the base 18). Additionally, the tapered distal edge 56 is upwardly tapered, as oriented in FIG. 2, beginning proximate the mounting portion 42 and extending toward the dispensing portion 46. Therefore, the portion of the tapered distal edge 56 farthest from the deformable lid 14 is nearest to the mounting portion 42 and the portion of the tapered distal edge closest to the deformable lid is nearest the dispensing portion 46.

The segmented skirt 52 further includes, below and proximate the dispensing portion 46, a cam surface 58 and a dispensing opening 60. As illustrated in FIG. 1, the cam surface 58 is an arcuate and/or rounded edge on the segmented skirt. In other embodiments, however, the cam surface can be angled, beveled, curved, and the like. The dispensing opening 60 is formed in a forward portion 62 of deformable lid 14. More particularly, dispensing opening may be formed in the segmented skirt 52 below the dispensing portion 46 near the forward portion 62. The dispensing opening 60 is sized and configured to dispense any contents disposed within the container assembly 10.

In one embodiment, at least one of the first and second hinges 48, 50 is integrally formed in the deformable lid 14. In an exemplary embodiment, at least one of the first and second hinges 48, 50 is a "living hinge" as known in the art. In either embodiment, the first and second hinges 48, 50 should be sufficient to withstand repeated and/or frequent use.

In one embodiment, the deformable lid 14 includes a radiused peripheral portion 64. In combination with the beveled portion 22, the radiused peripheral portion provides the container assembly 10 with a generally smooth outer surface that is compatible with a hand and fingers. As such, the container assembly 10 can be comfortably held by a user.

Turning to FIG. 2, the mounting portion 42 of the deformable lid 14 includes a hollow shaft 66 and/or tube. In one embodiment, a plurality of the hollow shafts 66 is disposed on the deformable lid 14. The number of these hollow shafts 66 may correspond to the number of shafts 26 employed on the container 12. In one embodiment, the hollow shafts 66 are secured to one or more of an inner mounting portion surface 68 and an inner segmented skirt surface 70. As shown in FIG. 2, the hollow shafts 66 can extend to a distal edge 72 of the segmented skirt 52 proximate the mounting portion 42. In other words, open ends 74 of the hollow shaft 66 are flush with the distal edge 72 of the segmented skirt 52. The open ends 74 are sized and dimensioned to receive the shafts 26 therein.

In one embodiment, the open ends 74 on the hollow shafts 66 receive the shafts 26 such that the hollow shafts and shafts are secured together by a friction fit. In an exemplary embodiment, when the container assembly 10 is assembled, the distal edge 72 of the segmented skirt 52 proximate the mounting portion 42 engages and/or rests upon the ledge 40 proximate the first end of the container 12 as shown in FIG. 4. With the shafts 26 friction fit and/or otherwise engaged with the hollow shafts 66, and the distal edge 72 engaged with and/or resting upon the ledge 40, the deformable lid 14 is mounted to and/or on the container 12. Moreover, in another exemplary embodiment, the segmented skirt 52 is sized and dimensioned to be slidably received into the open end 20 of the container 12, engage the inner wall 34 of the container, and produce a friction fit between at least a portion of the segmented skirt 52 and the inner wall. As shown in FIG. 3, when the deformable lid 14 is mounted on the container 12, the container assembly 10 is constructed. Notably, the container assembly 10 is illustrated in a "closed" position in FIG. 3.

Turning to FIG. 4, which also illustrates the container assembly 10 in the closed position, the engagement of the container 12 and the deformable lid 14 is illustrated. In the closed position, the deformable lid 14 has a generally planar surface and the dispensing opening 60 is disposed within the container 12. In one embodiment, a portion of the segmented skirt 52 proximate the dispensing portion 46 rests upon and/or is engaged with one of the second stops 30. Likewise, the cam surface 58 rests on and/or is engaged with the fulcrum 32. The tapered distal edge 56, however, is disengaged and distanced from the first stop 28.

Figure 5:
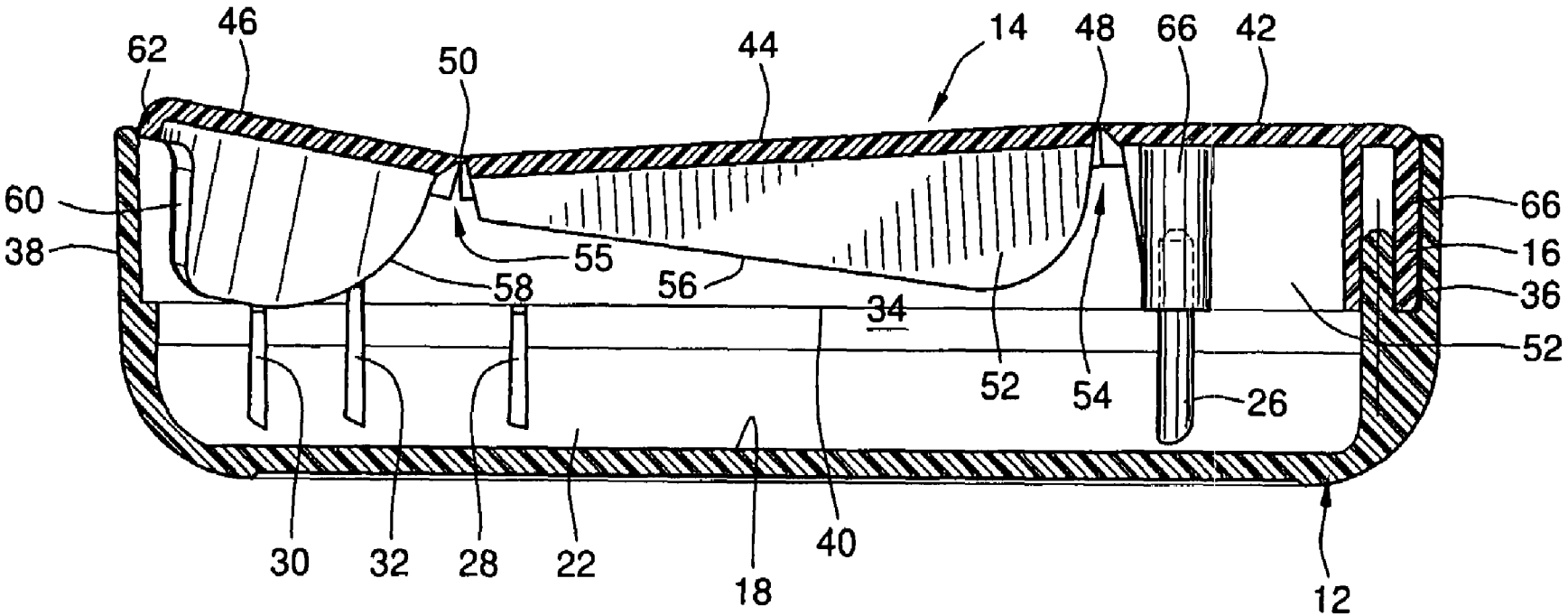
FIG. 5 is a cross-sectional view of the container assembly of FIG. 4 illustrating the container assembly transitioning towards an open position.
Figure 6:
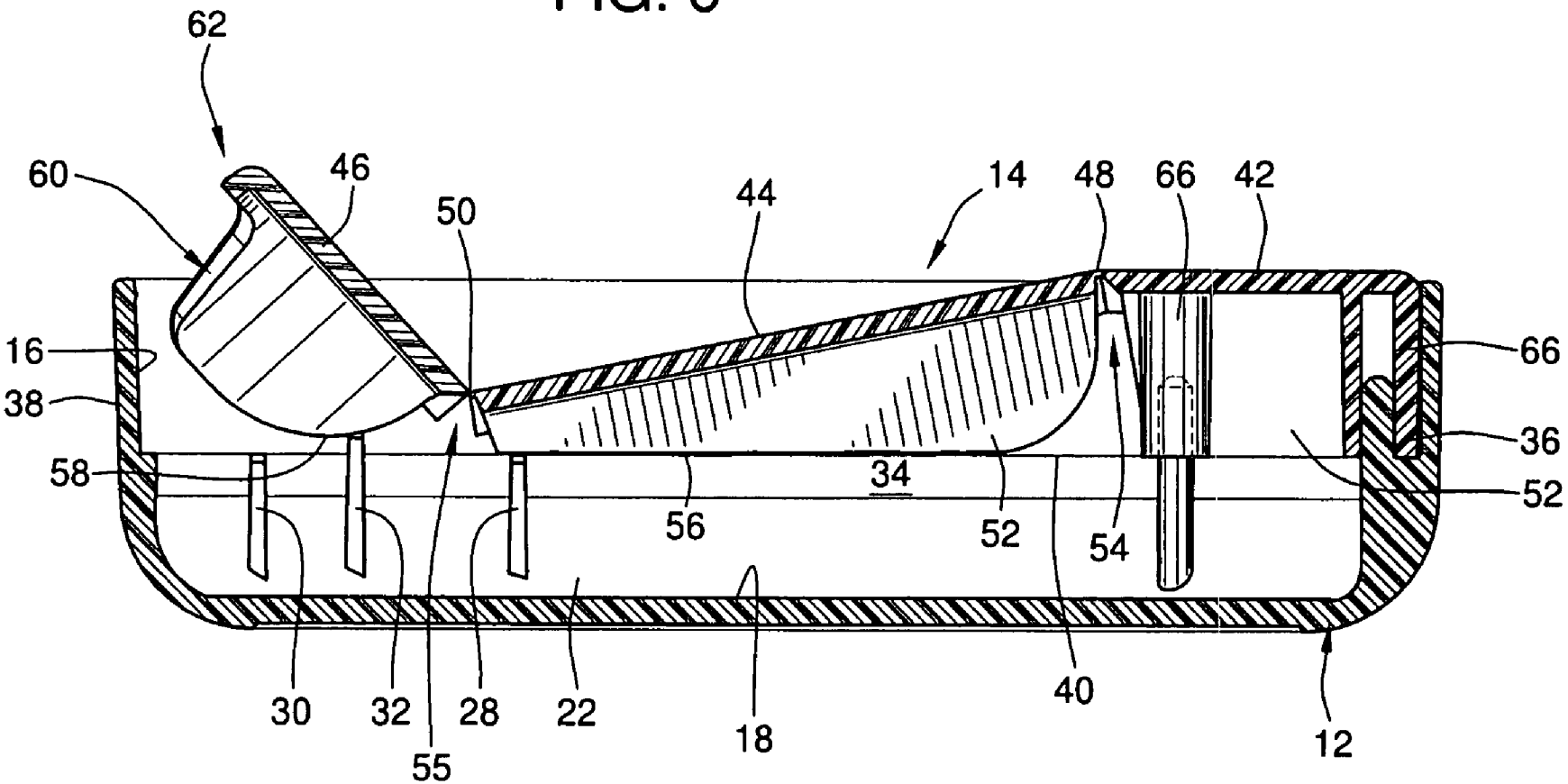
FIG. 6 is a cross-sectional view of the container of FIG. 4 placed in the open position.

As shown in FIG. 5, when the depressible portion 44 is depressed by, for example, a finger or a thumb, the depressible portion begins to collapse into the container 12. The depressible portion 44 is permitted to collapse inwardly by the first hinge 48. As the depressible portion 44 collapses, the gap 54 disposed proximate the first hinge 48 is compressed. Correspondingly, the gap 55 disposed proximate the second hinge 50 is expanded. Moreover, the cam surface 58 pivots upon and/or slides over the fulcrum 32. This movement causes the front portion 62 of the dispensing portion 46 to rise upwardly and away from the base 18 of the container 12. The movement of the cam surface 58 relative to the fulcrum 32 causes, in one embodiment, the second stop 30 to disengage from the segmented skirt 52 proximate the dispensing portion 46 as shown in FIG. 6. Eventually, the depressible portion 44 is depressed inwardly into the container 12 and toward the base 18 until the container assembly 10 is placed in the "open" position as illustrated in FIG. 6.

In the open position, in one embodiment, the dispensing opening 60 is no longer blocked by the wall 16 of the container 12. As such, the dispensing opening 60 is free to dispense any product disposed within the container assembly 10. Notably, the forward portion 62 of the dispensing portion 46 is also biased out of the container and/or upwardly away from the base 18. Also, the depressible portion 44 is collapsed into the container 12 such that the tapered distal edge 56 found on the portion of the segmented skirt 52 proximate the depressible portion is engaged with the first stop 28.

To transition the container assembly 10 from the open position of FIG. 6 back to the closed position of FIG. 4, the forward portion 62 of the dispensing portion 46 is depressed downwardly towards base 18 by a finger and/or a thumb. When this occurs, the cam surface 58 once again slides over and/or pivots upon the fulcrum 32 until the deformable lid 14 is once again in a generally planar condition. In other words, the depressible portion 44 and the dispensing portion 46 are, using the first hinge 48 and the second hinge 50, brought back into planar alignment with the mounting portion 42.

Advantageously, the container assembly 10 can be repeatedly opened and closed to dispense and retain, respectfully, any contents of the container assembly. The method of opening and closing the container assembly 10 is simple for a consumer or user to perform. Likewise, the container assembly 10 can be easily and quickly transitioned from the open position to the closed position using one hand and/or a single digit.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventor(s) for carrying out the invention. Variations of those preferred embodiments may become apparent to those of ordinary skill in the art upon reading the foregoing description. The inventor(s) expect skilled artisans to employ such variations as appropriate, and the inventor(s) intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A container assembly comprising:

a container having a base and an open end, a wall extending between the base and the open end, the container having a fulcrum; and a deformable lid including a mounting portion, a depressible portion, and a dispensing portion, the deformable lid mounted on the container to enclose the open end, the mounting portion joined to the depressible portion at a first hinge, the dispensing portion joined to the depressible portion at a second hinge, wherein, when the depressible portion is depressed toward the base, the first hinge permits the depressible portion to collapse into the container, the second hinge permits the dispensing portion to slide upon the fulcrum, and the fulcrum biases a forward portion of the dispensing portion away from the base such that the forward portion protrudes from the container.

2. The container assembly of claim 1, wherein at least one of the first and second hinges is a living hinge.

3. The container assembly of claim 1, wherein a segmented skirt depends from the deformable lid.

4. The container assembly of claim 3, wherein engagement of at least a portion of the segmented skirt with a ledge extending circumferentially about an inner wall of the container mounts the deformable lid on the container.

5. The container assembly of claim 1, wherein engagement of a shaft with a hollow shaft mounts the deformable lid on the container.

6. The container assembly of claim 1, wherein a friction fit mounts the deformable lid on the container.

7. The container assembly of claim 1, wherein the container assembly further comprises a first stop and a second stop, the first stop impeding travel of the depressible portion and the second stop disengaging from the dispensing portion when the depressible portion is depressed.

8. The container assembly of claim 1, wherein the dispensing portion includes a dispensing opening, the dispensing opening permitting a product to be dispensed from the container assembly when the depressible portion is depressed.

9. A container assembly comprising:

a container including a fulcrum, a first stop, and a second stop; and a deformable lid securable to the container, the deformable lid having a depressible portion and a dispensing portion, the depressible portion joined to the dispensing portion at a hinge, wherein, when the depressible portion is depressed, the depressible portion collapses into the container until the first stop is engaged, the dispensing portion slides upon the fulcrum and disengages from the second stop, and a forward portion of the dispensing portion protrudes from the container.

10. The container assembly of claim 9, wherein the deformable lid is securable to the container by engaging a shaft with a hollow shaft.

11. The container assembly of claim 9, wherein the container includes a ledge extending circumferentially about an inner wall of the container, the ledge acting as a boundary for at least one of the first stop and the second stop.

12. The container assembly of claim 9, wherein the container includes a ledge extending circumferentially about an inner wall of the container, the fulcrum extending away from the base and past the ledge.

13. The container assembly of claim 9, wherein the dispensing portion further comprises a cam surface and a dispensing opening, the cam surface engageable with the fulcrum, the dispensing opening proximate the forward portion and dimensioned for dispensing a product.

14. A container assembly comprising:

a container including a base portion and a wall portion, the wall portion having a shaft, a fulcrum, a first stop and a second stop; and a deformable lid having an open position and a closed position, the deformable lid including:

a mounting portion having a hollow shaft, the hollow shaft engageable with the shaft such that the deformable lid is securable to the container;

a depressible portion adjacent to the mounting portion, the depressible portion having a tapered distal edge, the tapered distal edge tapering upwardly away from the base portion beginning proximate the mounting portion, the tapered distal edge engageable with the first stop; and a dispensing portion adjacent to the depressible portion, the dispensing portion having a cam surface, an edge, and a dispensing opening, the cam surface slidable upon the fulcrum, the edge disengagable from the second stop, and the dispensing opening temporarily blocked by the wall portion of when the deformable lid is in the closed position;

wherein, when the depressible portion is depressed, the cam surface slides upon the fulcrum and the dispensing opening moves away from the base portion such that the dispensing portion is no longer blocked by the wall portion of the container.

15. The container assembly of claim 14, wherein the depressible portion collapses inwardly toward the base portion when the depressible portion is depressed.

16. The container assembly of claim 14, wherein the depressible portion collapses inwardly toward the base portion and at least a portion of the dispensing portion is simultaneously biased out of the container when the depressible portion is depressed.

17. The container assembly of claim 14, wherein the tapered distal edge engages with the first stop when the depressible portion is depressed.

18. The container assembly of claim 14, wherein the dispensing portion disengages with the second stop when the depressible portion is depressed.

19. The container assembly of claim 14, wherein the container includes a ledge, at least one of the first stop and the second stop is bounded by the ledge.

20. The container assembly of claim 14, wherein the container includes a ledge, the fulcrum projects away from the base and past the ledge.

* * * * *